US005602977A

United States Patent [19]

Lee

[11] Patent Number: 5,602,977

[45] Date of Patent: Feb. 11, 1997

[54] FRANKING MACHINE

[75] Inventor: Daniel J. Lee, Warley, United Kingdom

[73] Assignee: Neopost Limited, Essex, United Kingdom

[21] Appl. No.: 169,359

[22] Filed: Dec. 20, 1993

[30] Foreign Application Priority Data

Dec. 23, 1992 [GB] United Kingdom ..... 9226812

[51] Int. Cl.[6] ..... G07B 17/00

[52] U.S. Cl. ..... 395/117; 395/112

[58] Field of Search ..... 395/112, 117, 395/111, 109, 101; 380/23; 364/519, 464; 358/410

[56] References Cited

U.S. PATENT DOCUMENTS

| | | | |
|---|---|---|---|
| 4,122,532 | 10/1978 | Dlugos et al. | 364/900 |
| 4,611,232 | 9/1986 | Searby | 358/400 |
| 4,992,959 | 2/1991 | Hamada et al. | 364/519 |
| 5,038,153 | 8/1991 | Liechti | 346/140 |
| 5,111,030 | 5/1992 | Brasington et al. | 235/375 |
| 5,233,657 | 8/1993 | Gunther | 380/23 |
| 5,243,691 | 9/1993 | Kuwabara et al. | 395/112 |
| 5,257,197 | 10/1993 | Gunther et al. | 364/464 |

FOREIGN PATENT DOCUMENTS

| | | | |
|---|---|---|---|
| 0115876 | 8/1984 | European Pat. Off. | G07B 17/02 |
| 2803982 | 8/1978 | Germany | G06E 15/20 |
| 2070822 | 9/1981 | United Kingdom | G06F 3/16 |
| 2185939 | 8/1987 | United Kingdom | G07B 17/04 |
| 2232379 | 12/1990 | United Kingdom | G07B 17/02 |

OTHER PUBLICATIONS

European Search Report.
Search Report (GB).

*Primary Examiner*—Raymond J. Bayerl
*Assistant Examiner*—Steven P. Sax
*Attorney, Agent, or Firm*—Shoemaker and Mattare, Ltd.

[57] ABSTRACT

A franking machine is provided with a slogan memory to store one or more slogans for inclusion in impressions containing postage information on mail items. The slogan may be changed by input of audio signals representing print data for a new slogan through a wall of a secure housing of the franking machine to a microphone located inside the secure housing and connected to electronic accounting and control circuits for storage in the slogan memory and hence for subsequent use in printing impressions on mail items.

4 Claims, 1 Drawing Sheet

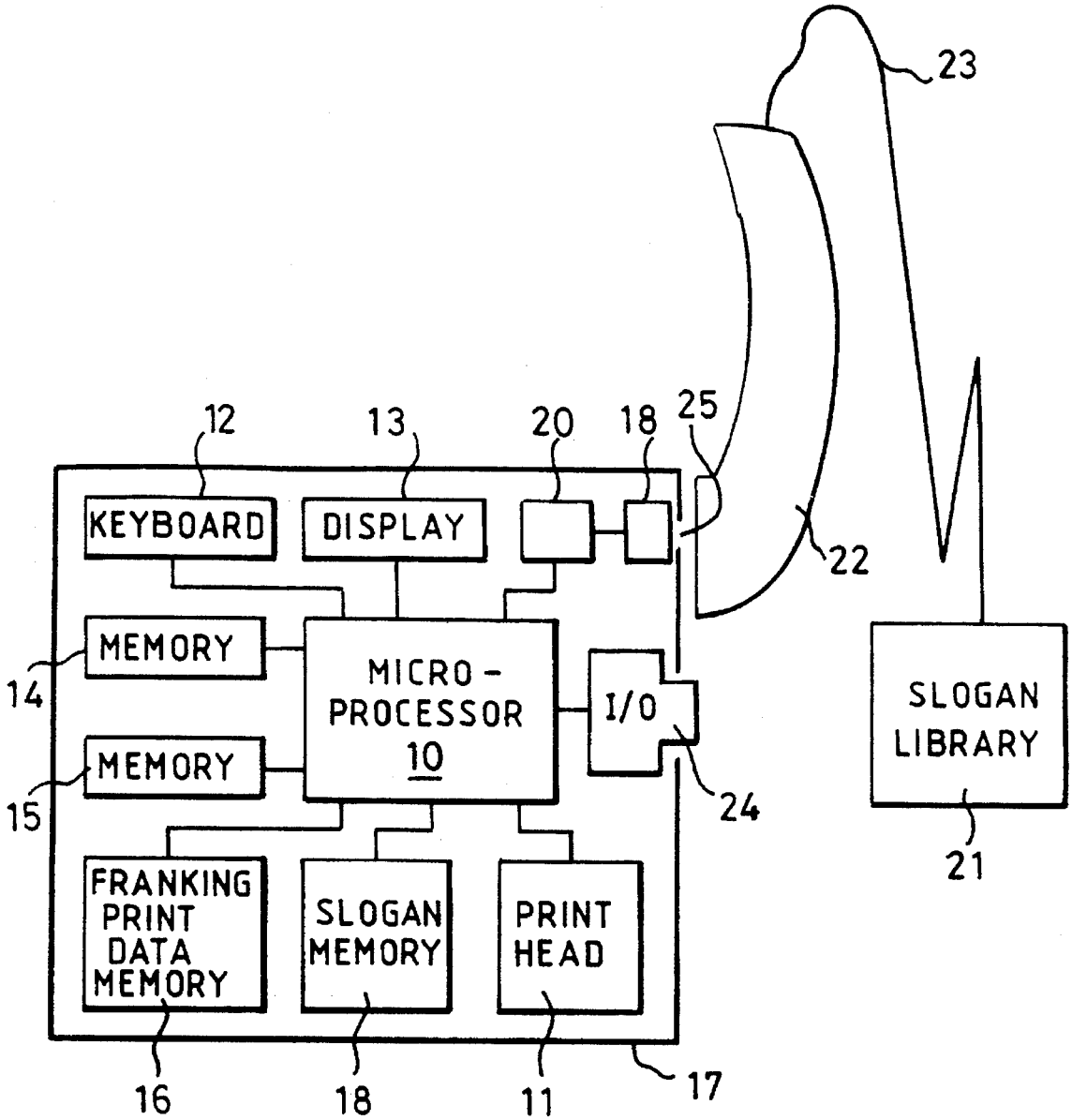
23
12
13
20
18
25
KEYBOARD
DISPLAY
22
MEMORY
14
MICRO-
PROCESSOR
10
I/O
SLOGAN
LIBRARY
MEMORY
15
24
21
FRANKING
PRINT
DATA
MEMORY
SLOGAN
MEMORY
PRINT
HEAD
16
18
11
17

FRANKING MACHINE

BACKGROUND OF THE INVENTION

This invention relates to franking machines and in particular to the input of data into such machines.

Known franking machines include electronic accounting and control circuits together with non-volatile memory for carrying out accounting operations in respect of accounting data relating to use of the franking machine in franking mail items and maintaining a record of current values of accounting data. The circuits also perform control functions including controlling operation of a printing device to print franking impressions on mail items. It is necessary to prevent unauthorised access to the accounting and control circuits and to the non-volatile memories otherwise tampering with the accounting data could occur which could result in fraudulent use of the franking machine. Accordingly in order to prevent unauthorised access to the accounting and control circuits and to the non-volatile memories and possible tampering with the accounting data, the circuits and memories are housed in a secure housing. Sealed access to the interior of the secure housing is provided for authorised personnel of the postal authority and for authorised service personnel of the franking machine supplier and its agents.

It is known to provide an input/output port in electronic franking machines to enable communication to take place between the circuits of the franking machine and other devices external to the franking machine. Communication may be required between the franking machine and weighscale in order to permit input of weights or postage charges directly from the weighscale to the franking machine circuits or to permit communication with a remote resetting computer to permit remote recrediting of a credit register of the franking machine. However it will be appreciated that the connections of the input/output port of necessity pass through the wall of the secure housing and in consequence pose a risk of breach of the security of the secure housing. Accordingly measures are taken to ensure as far as is practicable that application of unauthorised signals to the connections of the port cannot cause any malfunction of the electronic circuits within the secure housing.

Whereas known franking machines utilise a print drum carrying print dies for printing of the franking impression and when desired for printing a slogan alongside the franking impression, currently proposed franking machines use digital printing techniques for printing the franking impression and slogan. The use of digital printing techniques provides greater flexibility as compared with print dies as to the form of the impression printed. The digital printer is controlled to print a fixed pattern of the franking impression by means of franking print data stored in a memory and this print data is merged with variable postage charge print data and variable date print data output by the accounting circuits so that the printer prints a franking impression comprising both fixed pattern and variable data. Similarly print data defining an advertising slogan may be stored in a memory as described in application entitled FRANKING MACHINE filed in the name of Raymond J. Herbert on the same date as this present application and claiming priority from UK patent application No. 9226811.9. filed 23 Dec. 1992, the disclosure thereof hereby forming part of and being incorporated in this present application.

SUMMARIES OF THE INVENTION

According to one aspect of the invention a franking machine comprises electronic accounting and control circuits; non-volatile memory means to store accounting data, printing means controlled by said accounting and control circuits to print franking impressions on mail items to be franked; a secure housing containing said accounting and control circuits and said memory means; a microphone located within said housing; means responsive to electrical signals output from said microphone to input corresponding electrical signals to said accounting and control means; and means to transmit audio signals from the exterior of the housing to the microphone.

According to a second aspect of the invention a franking machine system includes a franking machine comprising electronic accounting and control circuits; non-volatile memory means to store accounting data; slogan memory means to store print data defining a slogan; printing means controlled by said electronic accounting and control circuits to print impressions on mail items to be franked, said impressions including postage information and a slogan defined by said print data; a secure housing containing said electronic accounting and control circuits, said non-volatile memory means and said slogan memory means; a microphone located within said secure housing; means to transmit audio signals from the exterior of the housing to the microphone to cause said microphone to output electrical signals corresponding to said audio signals; means responsive to electrical signals output from said microphone to input corresponding electrical signals to said electronic accounting and control means; and includes a telephone handset located adjacent said franking machine in audio communication with said microphone and remote means operable to transmit signals representing print data signals defining a slogan via a telephone network to said telephone handset; said electronic accounting and control means being operable in response to receipt of said transmitted signals to store in a said slogan memory the print data signals defining the slogan to be printed in the impressions.

BRIEF DESCRIPTION OF THE DRAWING

An embodiment of the invention will now be described by way of example with reference to the drawing which shows a block circuit diagram of a franking machine in accordance with the invention.

DESCRIPTION OF THE PREFERRED EMBODIMENT

Referring to the drawing a microprocessor 10 carries out accounting functions and controls operation of a printing head 11 to print a franking impression and a slogan on a mail item such as envelope. Preferably the printing head comprises a plurality of selectively heatable thermal printing elements disposed in a row. However if desired printing heads utilising other printing techniques such as dot impact or ink jet may be used. A keyboard 12 enables input of information and control signals to the microprocessor by a user of the franking machine and a display 13 driven by the microprocessor provides information relating to operation of the franking machine to the user. Non-volatile memory 14, 15 devices are provided to store accounting records relating to usage of the franking machine in franking mail items. The memory devices have storage locations providing a descending register to store a value of credit available for use in franking, an ascending register to store an accumulated value of postage used in franking mail items, an items register to store a count of the number of items franked and a high items register to store a count of the number of items franked with a postage charge in excess of a predetermined value. In order to ensure security and integrity of the accounting data and to enable reliable restoration of the accounting data in the event of a fault occurring each of the registers is duplicated in each of the memory devices 14, 15. The print head 11 is connected to the microprocessor 10 and is controlled by the microprocessor to print required information on the mail items. The printing elements of the print head 11 are selectively operable by signals from the microprocessor. The printing elements are disposed in a row transversely to the direction of feed of mail items and hence by selective operation of the printing elements in a plurality of print cycles during passage of the mail item past the printing elements, the required printed impression is built up column-by-column along the mail item. Upon selective operation of a thermal printing element, the area of ink layer of the ribbon adjacent the operated printing element is heated and is thereby transferred to the surface of the mail item. Data defining the fixed invariable parts of the franking impression is stored in a franking print data memory 16. The circuit elements of the franking machine as described hereinbefore are housed in a secure housing 17 in order to prevent unauthorised access to the circuits which could be used fraudulently to cause the franking machine to print franking impressions for which proper accounting had not been effected.

When a franking operation is to be performed, a user enters by means of the keyboard 12 a postage charge with which an item is to be franked and the microprocessor 10 carries out accounting procedures in which the required postage charge is checked against funds stored in the descending register available for use in franking. If the check indicates that there is sufficient credit available the microprocessor proceeds with a program routine whereby the account data stored in the registers is updated to account for the current franking operation being performed and then controls the print head 11 to print a franking impression on an envelope.

Control of the print head 11 by the microprocessor includes merging of print data signals read from the memory 16 relating to the invariable part of the franking impression with print data signals generated by the microprocessor relating to the postage charge and the date and then outputting the merged print data signals to the print head to cause the thermal print elements to be selectively energised in a series of print cycles to print the complete franking impression including the postage charge and date. When it is desired to print a slogan alongside the franking impression, print data signals defining the slogan design to be printed are stored in a non-volatile slogan memory 18. The microprocessor reads print data signals from the slogan memory 18 and, after outputting the print data signals defining the franking impression to the printer, the microprocessor outputs the print data signals defining the slogan design. Accordingly when the envelope is fed past the print head, first the franking impression is printed in a column-by-column manner in the upper right hand part of the envelope and then the slogan is printed in column-by-column manner to the left of the franking impression.

While a single slogan which remains unchanged may be sufficient for the needs of some users of franking machines other users may wish to be able to change the design of slogan printed as may be desired. This may be achieved by loading new data defining a new slogan design into the slogan memory. To enable loading of the slogan data, a microphone 19 is located in the interior of the secure housing immediately adjacent a small aperture 25 in the wall of the housing. The microphone is connected to the microprocessor 10 through circuit 20 which provides any signal conversion that may be required, for example conversion of analogue signals output from the microphone into digital signals for input to the microprocessor.

A slogan design library 21 is maintained, for example, by the supplier of the franking machine. The library contains data defining a plurality of slogan designs some of which may be accessible by any user and others of which are specific to specified users and are accessible only to those specified users. When a user wishes to load a new slogan design into the slogan memory 18, telephonic communication is initiated with the slogan library 21 via a telephone handset 22 and telephone network 23. When connection with the library is made, the user inputs, by means of the telephone handset keys, a slogan design identification number. The handset 22 is then positioned adjacent the aperture 25 in the secure housing such that sounds generated in the handset are transmitted through the aperture to the microphone. The library transmits, via the telephone network, DTMF signals representing print data signals defining the slogan design selected from the library by the user. The DTMF signals are received as audio signals by the microphone and output as electrical signals to the conversion circuit 20. The circuit 20 converts the signals from the microphone into digital signals which are input to the microprocessor 10. The microprocessor, in response to input of the signals defining a slogan design, writes the signals into the slogan memory 18 from whence in subsequent franking operations they are read out to print the slogan on mail items. While hereinbefore the slogan data is described as being transmitted by DTMF signals, other transmission methods may be used, for example FDM or FSK.

The slogan memory may be arranged to store data defining a single slogan design which is over-written each time a new slogan design is input to the franking machine or the memory may store a plurality of sets of print data defining a plurality of different slogan designs respectively. When an operator desires to frank a mail item, the operator inputs not only the desired postage charge on the keyboard but also selects a desired one of the different slogan designs. The microprocessor operates under a program routine which effects read out of that one of the print data sets corresponding to the slogan design selected by the operator to be printed. If desired the slogan printed may default to a predetermined one of the slogan designs if the operator does not select a slogan or a selected slogan may continue to be printed until such time as the operator inputs a selection of a different slogan design.

The microphone is located so as to prevent any physical access through the aperture to the interior of the secure housing and hence physical security of the housing is maintained. Additionally the microphone is of such a construction that electrical access cannot be obtained to the microphone or its connections. Alternatively the aperture may be such as to form a sinuous or impeded path to entry of any probe or the like into the aperture so as to prevent access by a probe or the like to the microphone.

The input of slogan print data by means of the microphone is convenient and provides a high degree of security. The volume of data required to define a slogan is approximately 3000 bytes so that at a transmission rate of 300 bps and 10 bits per byte the data for a slogan can be transmitted in approximately 100 seconds. In addition to input of data defining slogans, the microphone input may be utilised for input of data for other purposes and if so desired may be used instead of or in addition to an input/output port 24 comprising an electrical connector in the wall of the secure housing.

Instead of obtaining the print data defining a slogan design from a remote library via the telephone network, the audio signals may be recorded on a magnetic recording tape in a cassette, as used for audio recordings. The cassette is inserted in an audio reproducer, as used for listening to recorded music, and with an earphone or sound output device of the reproducer positioned adjacent the franking machine so as to be in audio communication with the microphone, the record is played back and input to the microphone in the same manner as from the telephone handset. Thus a user may have a number of cassettes on which different slogan designs are recorded and may then enter any selected slogan design into the franking machine.

I claim:

1. A franking machine comprising non-volatile memory means to store accounting records relating to useage of the franking machine in franking mail items; electronic accounting and control circuits; input means operable to input a postage charge to said electronic accounting and control circuits; said electronic accounting and control circuits being operative to carry out accounting functions in relation to postage charges for franking mail items and to write said accounting records to said memory means; printing means controlled by said electronic accounting and control circuits to print a franking impression on a mail item to be franked, said franking impression including said postage charge; a secure housing containing said electronic accounting and control circuits and said non-volatile memory means; said secure housing being effective to prevent unauthorised tampering with said electronic accounting and control circuits and said non-volatile memory means contained therein; a microphone located within said secure housing; means responsive to electrical signals output from said microphone to input corresponding electrical signals to said electronic accounting and control circuits; and means enabling audio signals to pass from the exterior of said secure housing to the microphone.

2. A franking machine as claimed in claim 1 wherein the microphone is located immediately adjacent an exterior wall of the secure housing and said exterior wall has an aperture extending therethrough enabling the audio signals to pass from the exterior of said secure housing to said microphone.

3. A franking machine as claimed in claim 1 including slogan memory means to store print data defining a slogan design to be printed by the printing means; and wherein the audio signals represent print data defining a new slogan and the electronic accounting and control circuits are operative to write said print data to the slogan memory means and during a franking operation to read out said print data from the slogan memory means to control the printing means to print the new slogan alongside the franking impression.

4. A franking machine system including a franking machine comprising electronic accounting and control circuits; input means operable to input a postage charge to said electronic accounting and control circuits; non-volatile memory means to store accounting records relating to usage of the franking machine in franking mail items; slogan memory means to store print data defining a slogan; printing means controlled by said electronic accounting and control circuits to print an impression on a mail item to be franked, said impression including said postage charge and said slogan defined by said print data; a secure housing containing said electronic accounting and control circuits, said non-volatile memory means and said slogan memory means; said secure housing being effective to prevent unauthorised tampering with said electronic accounting and control circuits and said non-volatile memory means contained therein; a microphone located within said secure housing; means operative to enable audio signals to pass from the exterior of said secure housing to said microphone; said microphone being operative in response to said audio signals to output first electrical signals corresponding to said audio signals; means responsive to said first electrical signals output from said microphone to input second electrical signals corresponding to said first electrical signals to said electronic accounting and control circuits; and including a telephone handset located exterior to said secure housing and adjacent said franking machine in audio communication, via said means operative to enable said audio signals to pass from the exterior of said secure housing said microphone, with said microphone and remote means operable to transmit telephone signals representing print data signals defining said slogan via a telephone network to said telephone handset; said telephone handset being operative to convert said telephone signals to audio signals for reception by said microphone; said electronic accounting and control circuits being operable in response to input of second electrical signals resulting from receipt by said microphone of said transmitted telephone signals to store in said slogan memory the print data signals defining the slogan to be printed in said impression.

* * * * *